United States Patent [19]

Yang

[11] Patent Number: 4,962,918

[45] Date of Patent: Oct. 16, 1990

[54] CLAMPING SET HAVING DOUBLE-COORDINATE CLAMPING FUNCTION AND BEING EXTENSIBLE FOR ADJUSTING CLAMP DEPTH

[76] Inventor: Tai-Her Yang, 5-1 Taipin St., Si-Hu Town, Dzan-Hwa, Taiwan

[21] Appl. No.: 347,202

[22] Filed: May 4, 1989

[30] Foreign Application Priority Data

May 17, 1988 [GB] United Kingdom ..... 8811613

[51] Int. Cl.[5] ..... B25B 1/10

[52] U.S. Cl. ..... 269/156; 269/249; 269/208

[58] Field of Search ..... 269/249, 156, 165, 208, 269/43, 45

[56] References Cited

U.S. PATENT DOCUMENTS

| | | | |
|---|---|---|---|
| 1,587,820 | 6/1926 | Carter | 269/249 |
| 2,568,233 | 9/1951 | Hamilton | 269/43 |
| 2,642,905 | 6/1953 | Hewat | 269/156 |
| 3,934,316 | 1/1976 | Driscoll | 269/249 |
| 4,234,176 | 11/1980 | Goff et al. | 269/249 |

*Primary Examiner*—Robert C. Watson
*Attorney, Agent, or Firm*—Leonard Bloom

[57] ABSTRACT

A "C" type clamping assembly comprising first and second legs and an adjustable length main body therebetween. A first clamping assembly is adjustably movably received on the main body; the first clamping assembly being a bifurcated strap having two legs and a plurality of teeth on each leg. A U-shaped slide blocks straddles the bifurcated strap and has teeth which cooperate with the teeth on the bifurcated strap. A threaded clamping rod is received in the slide block and the slide block may be moved laterally across the bifurcated strap to a desired position such that the clamping rod may engage a workpiece. A second and a third clamping assembly are adjustably mounted on the ends of the respective first and second legs such that the clamping assemblies may extend outwardly from the ends of the respective legs as desired. The second and third clamping assemblies each have a threaded clamping rod received therein. A workpiece of irregular shape may be securely clamped between the independently adjustable first, second and third clamping members.

3 Claims, 5 Drawing Sheets

CLAMPING SET HAVING DOUBLE-COORDINATE CLAMPING FUNCTION AND BEING EXTENSIBLE FOR ADJUSTING CLAMP DEPTH

SUMMARY OF THE INVENTION

A kind of double-coordinate C-type clamp, which primarily relates to the characteristics as: two extension arms on end of C-type embodiment having synclastic folding angle, so as to enable C-type clamp on fixed position to have clamping function within the dimension of vertical and horizontal double-coordinate, and furtherly to have improving design for being extensible for adjusting clamp depth and direction, and based on the aforesaid designated basis, we thereby can make bilateral C-type clamp, three-way C-type clamp, in order to be advantageous for those of broad clamping application.

BRIEF DESCRIPTION OF THE INVENTION

FIG. 1 is a solid-diagrammatic view of the double-coordinate C-type clamp.

FIG. 1 A is a top view of FIG. 1.

FIG. 1 B is a side view of FIG. 1.

FIG. 1 C is a diagramatic view of the clamping scope for the double-coordinate clamping device.

FIG. 2 is a solid-diagramatic view of double-coordinate C-type clamp made by punch press.

FIG. 2 A is a top view of FIG. 2.

FIG. 2 B is a side view of FIG. 2.

FIG. 3 is a solid-diagramatic view of clamping set having double-coordinate clamping function and unadjustable clamp head.

FIG. 3 A is a perspective view of an inward directed clamping head.

FIG. 3 B is a perspective view of an outward directed clamping head.

FIG. 3 C is a perspective view of a fixed head structure.

FIG. 3 D is a perspective view of a clamping head on one of the extension arms.

FIG. 4 is a solid-diagramatic view of the three-way clamp having double-coordinate clamping function.

FIG. 4 A is a top view of FIG. 4.

FIG. 4 B is a side-sectional view of FIG. 4.

FIG. 4 C is a front view of FIG. 4.

FIG. 5 is a solid-diagrammatic view showing such kind of being extensible for adjusting clamp depth and clamp direction being utilized by the structure of three-way clamp.

FIG. 5 A is a solid-diagramatic view of C-type clamp embodiment when bilateral clamp being formed.

FIG. 5 B is a solid-diagramatic view of a practical example showing there has penetrating extension hole between adjustable extension arm and C-type embodiment.

FIG. 5 C is a solid view of a practical example showing it having penetrating extension hole and adjustable pitch arm is utilized.

FIG. 5 D is a diagramatic view of a practical example showing one arm of bilateral or three-way clamp having fixed clamp head.

DETAILED DESCRIPTION OF THE INVENTION

Figure 1:
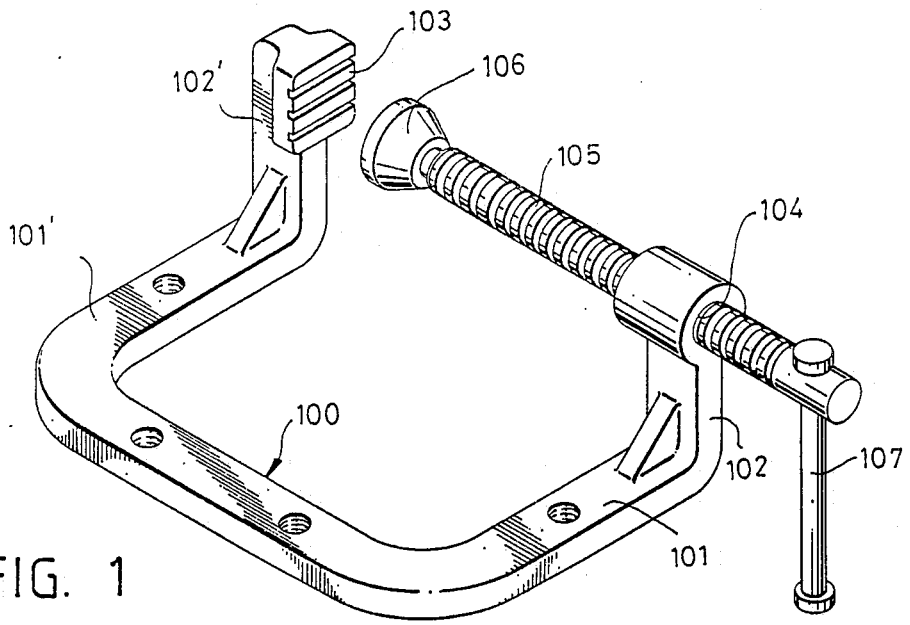
Figure 1A:
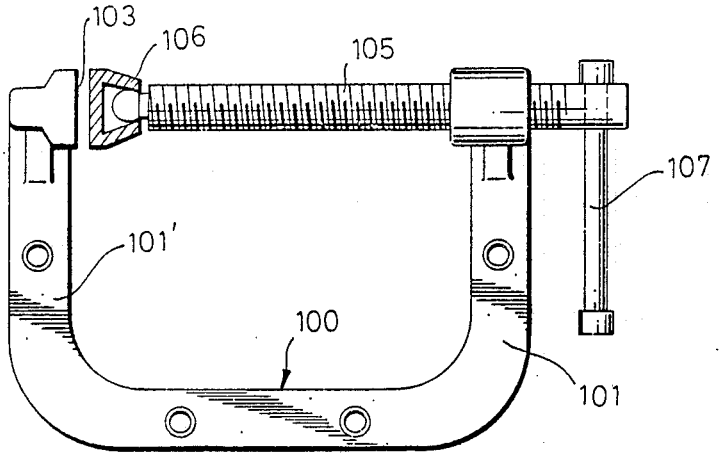
Figure 1B:
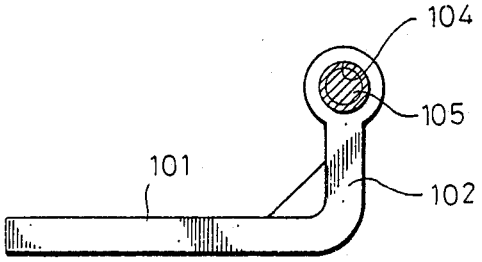
Figure 1C:
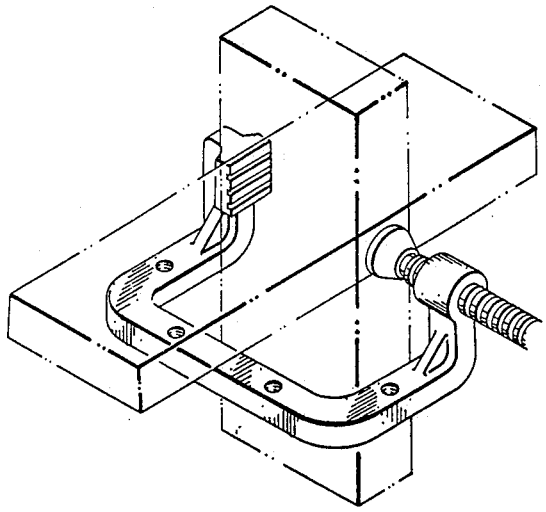

Any conventional C-type clamp (as shown in reference FIGS. A, B, C), relates to the characteristics as, its embodiment, extension arm and clamping screw are all located at the same plane. It has been widely used for clamping many kinds of workpieces to be done for various kinds of process. However, relating to practical application, we might need special requirement for working as shown in Reference FIG. D, in which, when multiple sets of C-type clamping set are utilized on work table as a clip, if we adopted conventional C-type clamp, it should be forced close to the table surface, as its structure is formed into oblate embodiment according to dynamic principle, and so its longitudinal section (as shown in Reference FIG. E) with smaller space will be forced close to the table surface and thereby shall damage its surface and not easily by fixed. In the practical example of this design, it has two extension arms on end of embodiment and the extension of synclastic folding angle, which enable C-type clamp at fixed position to have a structure of clamping function within the scope of lateral and vertical double-coordinate. Therefore, the applied case discloses as shown in Reference FIG. D, stamping on table surface by the section with larger space, which shall be more advantageous. Hereby to describe various kinds of practical example of the double-coordinate C-type clamping set as below:

As shown in FIGS. 1, 1 A, 1 B, which are the practical examples of the double-coordinate C-type clamp. In which, FIG. 1 is a solid-diagramatic view of the double-coordinate C-type clamp, FIG. 1 A is a top view of FIG. 1, FIG. 1 B is a side view of FIG. 1, and in the FIG., 100 represents C-type clamp embodiment, those two ends of parallel faces at its same lateral side are extending synclastically to form the 1st bending extension arms 101, 101', and then extending laterally at the same side to form the 2nd bending extension arms 102, 102', and tap hole 104 which is likely parallel to embodiment is installed on the end of one set of extension arm, to be available for penetrating clamping screw 105, and the interior side of clamping screw 105 has universal clamp head 106, its the other end has drive head 107 which is provided for rotating/driving to and fro. the interior side on the end of another 2nd bending extension arm has plane shape fixed clamp head 103 in company with the aforesaid to do counter clamp or to have same tap hole as the aforesaid end providing for the installation of screw having universal clamp head and drive head.

FIG. 1 C is a diagramatic view of clamping scope for the double-coordinate clamping device, in which, it is visible that, when C-type clamp is fixed, it will be suitable for lateral and vertical clamping condition, which is excluded from the conventional type.

Figure 2:
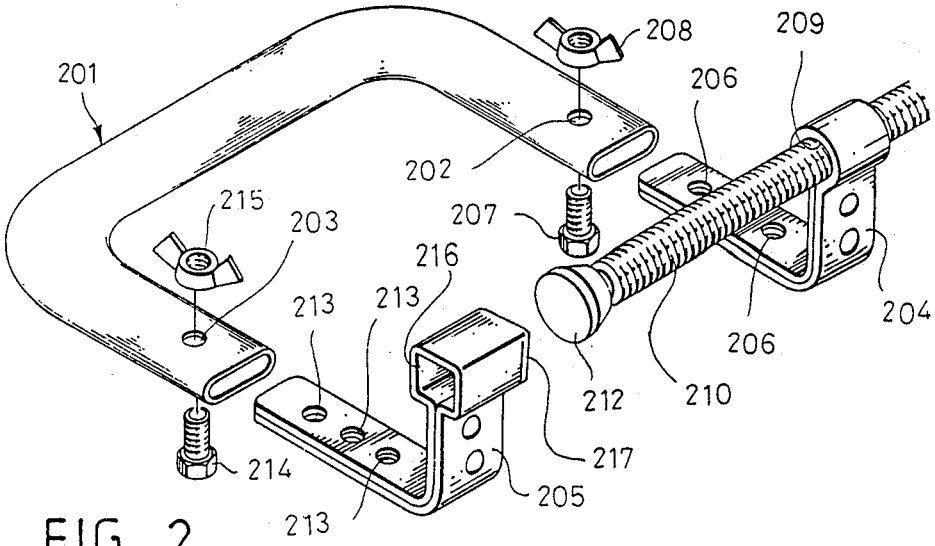
Figure 2A:
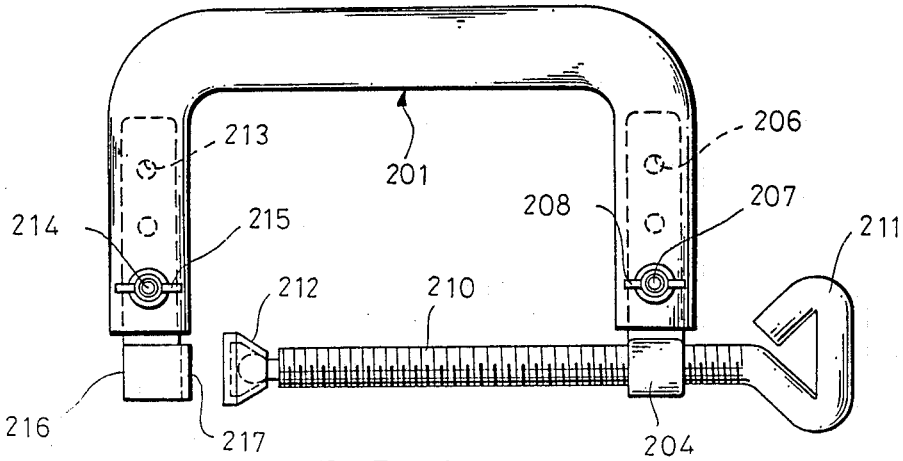
Figure 2B:
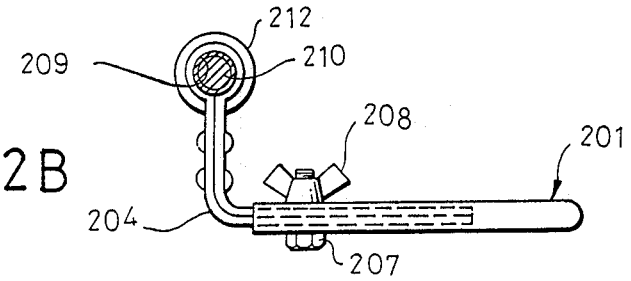

Another, every way of embodiment itself may have penetrating hole or tap hole for being locked on the table or provided for joining link rod with thread. FIG. 2 is a solid-diagramatic view of the double-coordinate C-type clamp made by punch press. FIG. 2 A is a top view of FIG. 2. FIG. 1 B is a side view of FIG. 1, in which, its major structure comprises:

A C-type embodiment 201 is in oblate-tube shape, the end of its two extension respectively has at least a set of adjustable joint hole 202, 203 (or solid iron sheet, its extension ends have at least two sets of joint holes);

A semi-close "L" clamp end head made of sheet materials by punch press molding, its slit end is cased into one end of C-type embodiment 201 for adjusting the extension of clamping arm or deciding the clamping direction, it also has joint hole 206 providing for nut 208 joining embodiment 201 by bolt 207, Its ring-shape head round hole is provided for tapping and therefore formed into tap hole 209 being provided for forcing screw 210 being screwed inside, one end of forcing screw has drive head 211, and another end has universal forcing head 212;

Another set of semi-close "L" clamp end head 205 is made of sheet materials by punch press molding, its slit end can be adjusted and cased into another end of C-type embodiment 201 for adjusting the extension of clamping arm or deciding the clamping direction, and it also has joint hole 213 providing for nut 215 joining embodiment 215 by bolt 214, or its ring-shape head 216 has a sealing face 217 providing for fixed clamping face.

Figure 3A:
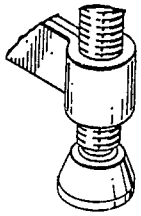
Figure 3B:
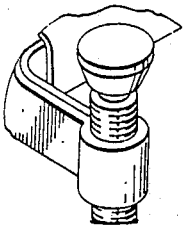
Figure 3C:
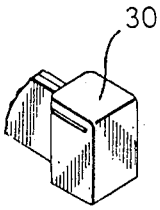
Figure 3D:
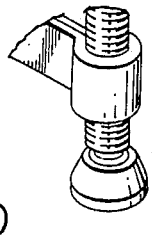
Figure 3:
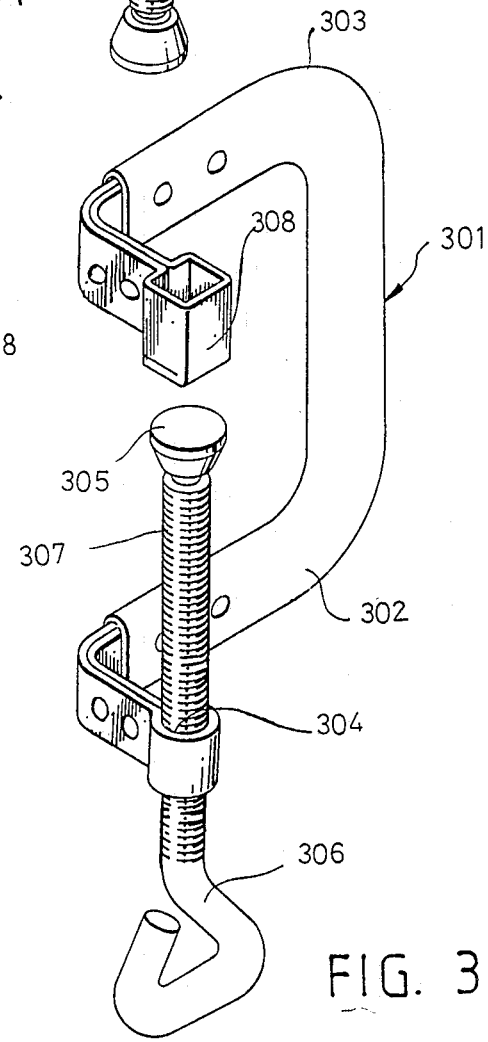

Another, both ends of the aforesaid C-type embodiment also can be fixedly riveted with "L" end head having forcing screw at the same time, and becomes a kind of structure of external-support or interior clamp. As shown in FIGS. 3–3D, it is a practical example showing clamping set having unadjustable clamp head and double-coordinate clamping function, in which, its major structure comprises:

A C-type embodiment 301, its two extension arms 302, 303 are both formed into synclastic bending, the end of one extension arm has a longitudinal penetrating tap hole 304 providing for one end with universal clamp head 305 being screwed inside, and another end of clamping screw having drive head 306, becomes counter clamp (or becomes reversed external-support);

The aforesaid two extension arm 302, 303, one of their lateral also can have fixed clamp head structure 308, and the clamp head structure will be installed on interior side when it is used for clamping structure to clamp screw 307 inwards; if it is used for clamping screw outwards and becomes external-support structure, it will be installed on outer lateral.

Figure 4:
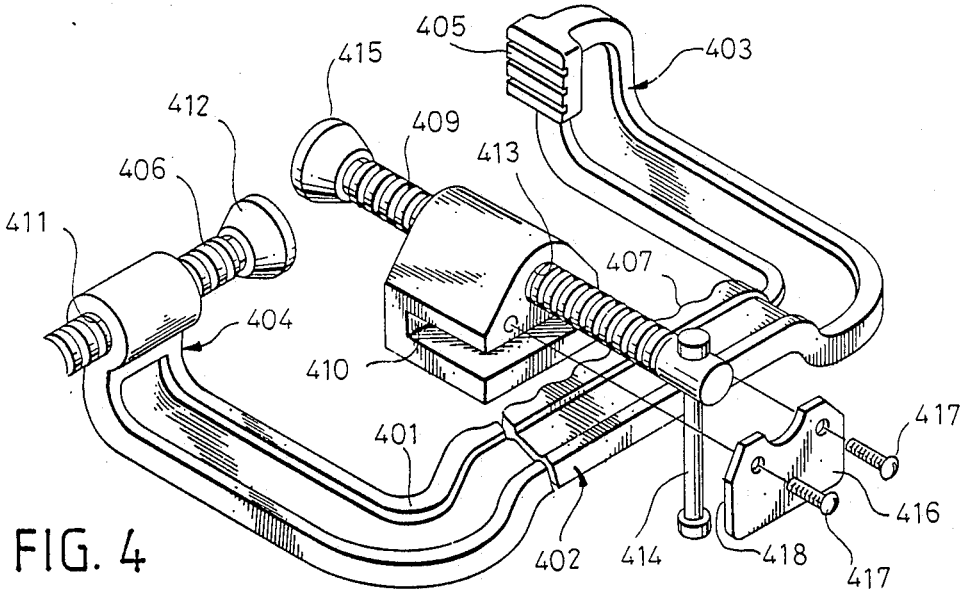
Figure 4A:
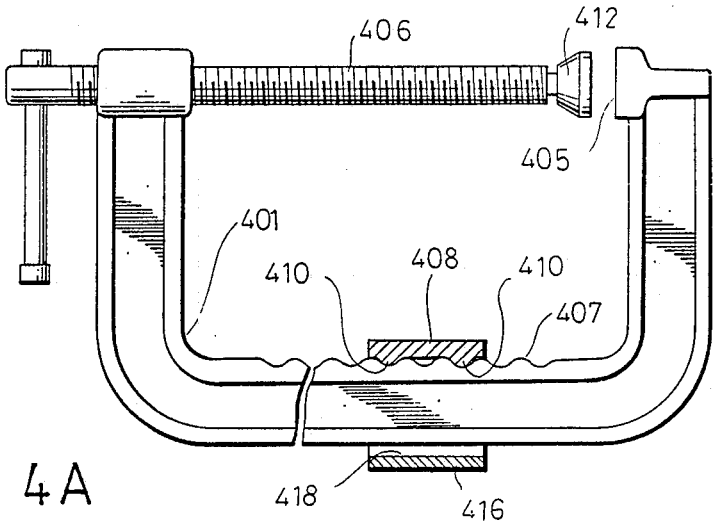
Figure 4B:
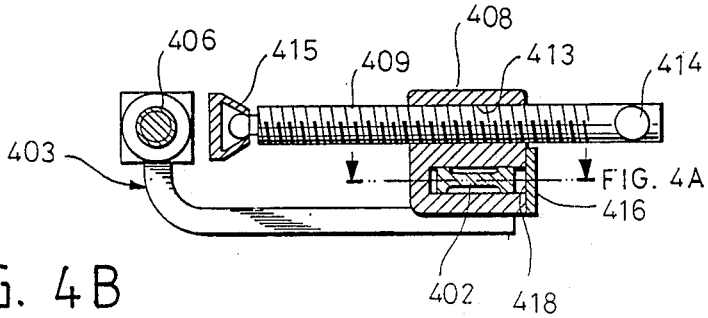
Figure 4C:
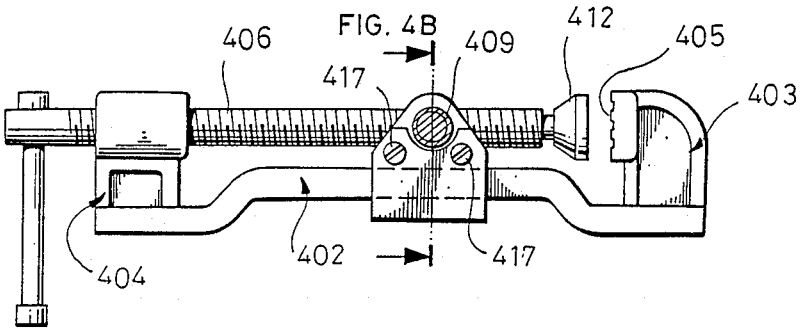

The double-coordinate clamping function which is utilized in "T" clamp is as shown in FIGS. 4 and 4 C, in which, position adjustable type three-way clamp has double-coordinate clamping function is therein practised, and FIG. 4 is a solid-diagramatic view of three-way clamp has double-coordinate clamping function, and FIG. 4 A is a top view of FIG. 4, FIG. 4 B is a side-sectional view of FIG. 4, FIG. 4 C is a front view of FIG. 4; the intermediate section 402 of embodiment 401 is found upwards shaping bridge form and protruded, and its bottom section has two ends 403, 404, which are bending synclastically with bridge-shape section protruded from the intermediate section, and respectively form one end having fixed clamp head 405, and another end having forcing screw 406 to construct clamping function. The interior side which is bridge shaped and convex on intermediate section 402, has teeth shape 410, provided for coupling with slide block 408 which has clamping screw 409, the interior side of slide block 408 embodiment has convex teeth 410 for being inlaid mutually each other with convex teeth 407 of bridge-shape and convex interior side on intermediate section of the aforesaid embodiment, and thereby to construct positioning function. The relationship among its major structure is described as below:

A clamp embodiment 401 which is formed into C-type structure, its intermediate section is found bridge-shape and convex, its convex height is available for slide block 408 being installed inside but stamped on a plane and free from interruption of the displacement of slide block 408, its extension ends 403, 404 are also found synclastically bending with bridge-shape and convex section, it also has tap hole 411 for forcing screw 406 being screwed inside (or one of its end is fixed clamp head 405), one end of forcing screw 406 has drive head, and another end has universal clamp head 412;

The bridge-shape and convex intermediate section 402 of embodiment is provided for coupling with slide block 408 embodiment which has tap hole 413 for lateral penetrating forcing screw 409 being screwed inside, slide block embodiment is found " " shape with thick top and thin bottom, its thick side has lateral tap hole 413 for forcing screw 409 with one end having drive head 414 and another end having universal clamp head being screwed inside, the teeth shape 410 in its interior is convex towards opening lateral and is coupling with teeth section 407 of embodiment for mutually inlaid each other and positioning, its opening lateral additionally has fixing sheet 416 joining " " shape slide block opening lateral to form close function by utilizing the bolt 417 or the other ways;

After closed, the distance between inner convex teeth 410 of slide block 408 and closed face 418 should be little larger than the width of bridge-shape intermediate section of embodiment, provided for sliding adjustment thereon.

Another, the aforesaid extensible for adjusting clamping arm structure, can be furtherly utilized in conventional bilateral C-type clamp or three-way clamp. Conventional bilateral C-type clamp (as shown in Attachment A) or three-way clamp both have fixed clamping depth, and therefore, they should be minimized by their fitness for usage owing to the size of workpiece and limit of working space normally, e.g., to clamp for helping adhesion, which can not clamp workpiece owing to depth, or can not be used due to over deep depth and thereby limited by space.

Figure 5:
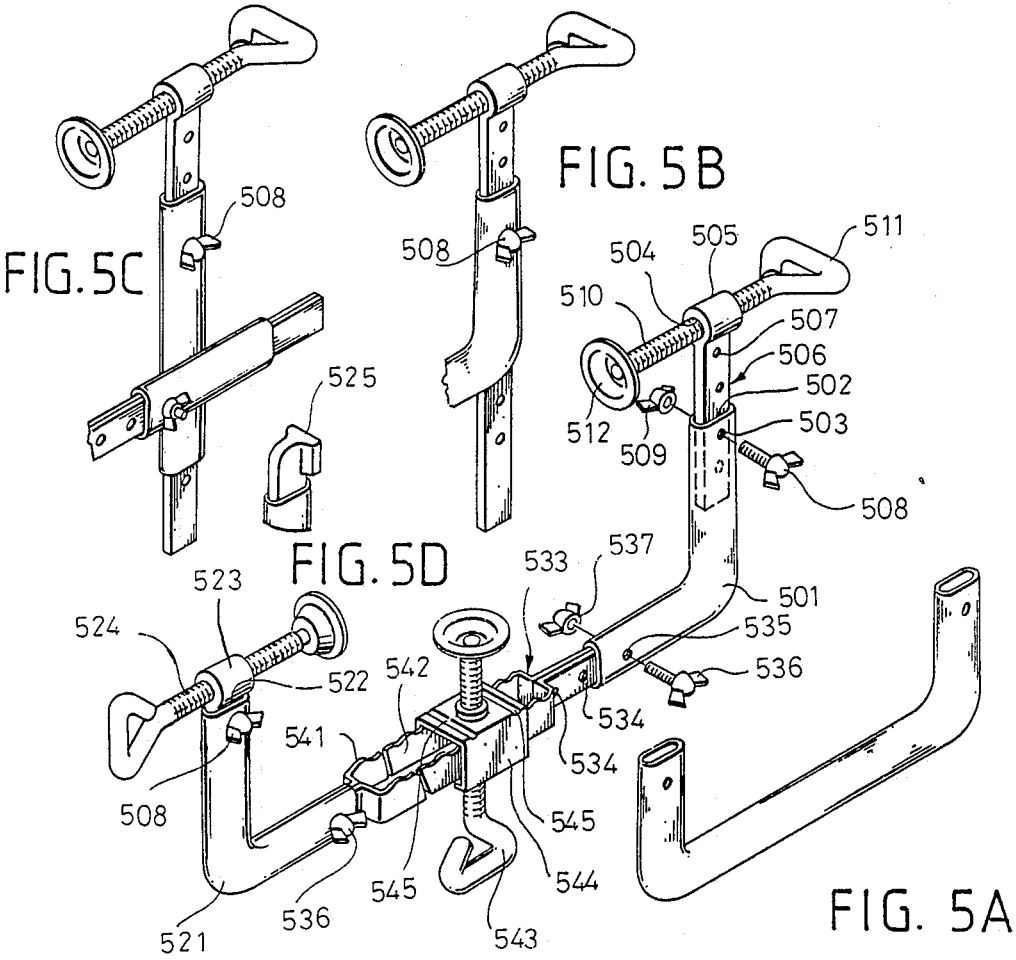

The characteristics of this design relating to the extensible device for adjusting the clamping depth and clamping direction is utilized in bilateral C-type clamp or three-way clamp structure, which are hereby described as below: FIG. 5 is a solid-diagramatic view of this extensible device for adjusting the clamping depth and clamping direction to be utilized in three-way clamp structure. FIG. 5 B is a solid-diagramatic view of a practical example, showing there has penetrating extension hole between adjustable extension arm and C-type embodiment. FIG. 5 C is a diagramatic view of a practical example, showing it has penetrating extension hole and pitch adjustable arm. FIG. 5 D is showing one of its arm having fixed clamp head which can adjust clamping depth. In FIG. 5, its major structure comprises:

The 1st set has oblate tube (flattened tubular section) 501 with oblate and parallel hole 502, the oblate tube 501 is found in "L" bending, lateral penetrating hole 503 is installed on it, its one lateral facing clamping arm has oblate and parallel hole 502 providing for leading into clamp head 505 having vertical tap hole 504, the clamp head 505 has long-bar shape neck portion 506 which can mutually case and slide with the aforesaid oblate and parallel hole 502 each other, neck portion 506 has positioned hole 507 providing for being adjusted for joining the aforesaid lateral penetrating hole 503 by utilizing screw 508 and nut 509 in order to adjust the extension length of clamp head 505, and furtherly adjust its clamping depth;

A clamping screw 510 is installed on clamp head 505, one end of clamp head has a drive head 511, and another end has a forcing head 512 providing for driving/forcing workpiece;

The 2nd set has oblate tube 521 with oblate and parallel hole 522, the oblate tube 521 is found in "L" shape bending, which is provided for the installation of clamp head 523 and clamping screw 524 or clamp head having a fixed clamping face 525 without additional installation of clamping screw as the same as the aforesaid 1st set;

The aforesaid two sets have parallel tube with oblate and parallel hole, which can be made into one-piece structure or these two sets have parallel tube found in "L" bending and having oblate and parallel hole, another end without installation of clamp head 505, 523 has intermediate supporting rod (flat strap section) 533 which is available for mutually cased with the aforesaid oblate and parallel hole, supporting rod 533 has joint hole 534 for being cased into the aforesaid "L" oblate tube-shape hole and riveted with its joint hole 535, or providing for dismantling and pitch adjustable joint by utilizing screw 536 and nut set 537; the intermediate section of the intermediate supporting rod 533 is found teeth shape 541 in its interior side and parallel slot shape 542 in its intermediate portion, and its both ends are found in oblate shape and has joint hole 534 providing for being cased into the aforesaid "L" oblate tube hole, and riveted with its joint hole 535, or providing for joint by utilizing bolt and nut set, and intermediate slot 542 is provided for "U" slide block 44 with lateral clamping screw 543 being installed, "U" slide block 544 is installed into from interior side of slot 542 outwards, its two laterals are found in convex teeth 545 which is provided for mutually inlaid with convex teeth 541 of slot each other for positioning;

In the adjustable joint structure of the aforesaid with bolt and nut, which can adjust the extension length of clamp arm by dismantling bolt and nut set, and furtherly can adjust its clamping depth, so as to change its clamping pitch, and furtherly change its clamping direction into supporting outwards.

Another, those 2 sets of "L" bending tube with oblate and parallel hole, which is available for the extensible clamping arm being installed inside, also can be made in one piece body and formed into "U" structure in order to become bilateral C-type clamp as shown in FIG. 5 A; between the aforesaid extensible clamping arm and "L" bending tube with oblate and parallel hole, there also can have structure having penetrating extension hole in order to increase the volume of clamping depth as shown in FIG. 5 B; or, it can furtherly have "cross" bilateral penetrating extension hole so as to maximize adjusting the clamping depth and distance as shown in FIG. 5 C; in addition, one of the arms of the aforesaid bilateral or three-way clamp also can have fixed clamp head as shown in FIG. 5 D, and this fixed head is installed by double faces type to be for clamping joint or supporting externally.

Every aforesaid practical example is to utilize structural feature of the end of embodiment bending towards same lateral in order to obtain double-coordinate clamping function, or to utilize extensible adjusting and direction transfer of clamping arm structure to reach adjustable clamping depth or clamping direction, also can utilize both or either of the aforesaid feature(s) being installed in bilateral or three-way clamp to expand practical function of clamping set but increase small costs (need only to increase few kinds of materials). Its functions and structure are found to be in newly type, and so please survey this case in accordance with the laws.

I claim:

1. A "C" type clamping assembly comprising in combination a flattened tubular frame having a main body, a first leg and a second leg, the legs being substantially parallel and at right angles to the main body, the main body;

having an intermediate section, the intermediate section being a bifurcated strap having two legs and having a plurality of upwardly extending teeth on each leg of the strap, the intermediate section further having a first flat strap section and a second flat strap section, each flat strap section extending outwardly in opposite directions from the bifurcated strap; a U-shaped slide block having at least two downwardly extending teeth thereon, the U-shaped block straddling the bifurcated section, the teeth on the U-shaped block cooperating with the teeth on the bifurcated section such that the U-shaped slide block may be moved laterally across the intermediate bifurcated section and secured in a desired position, the U-shaped block further having a threaded opening therethrough, a first threaded clamping rod being received in the threaded opening;

the first threaded rod having a first end extending outwardly from the frame for manual adjustment, the first threaded rod having a second end extending inwardly from the frame and having a first clamping member mounted thereon such that lateral movement of the U-shaped block produces similar lateral movement of the first clamping member;

the first flat strap section on the intermediate section being slidably received in the tubular frame of the main body near the first leg of the assembly, the second flat strap section of the intermediate section being slidably received in the tubular frame of the main body near the second leg of the assembly, the first flat strap section and the second flat strap section each having a plurality of spaced-apart transverse openings therein, the tubular frame section near the first leg and the tubular frame section near the second leg each having at least one transverse opening therein such that when the respective flat strap section slides in the respective tubular section the selected opening in the flat strap section communicates with the respective opening in the tubular frame section permitting adjustment of the size of the main body; a pin member removably received in the respective opening in the tubular frame section and in the respective communicating opening in the flat strap section such that the respective flat strap section is secured to the respective tubular frame section; means to secure the pin member in the opening;

the first leg and the second leg each having a respective end;

a second clamping assembly mounted on the end of the first leg and a third clamping assembly mounted on the end of the second leg, means for mounting the second and third clamping assemblies to the respective leg, the means for mounting the second and third clamping assemblies on the ends of the respective first leg and second leg being adjustable such that the second and third clamping assemblies may be extended outwardly from the end of the first leg and the end of the second leg; and the second and third clamping assemblies each having a threaded opening therethrough, a second and a third threaded clamping rod being received in the respective second and third threaded openings, the second and third threaded rods each having a first end extending outwardly from the clamp for manual adjustment, the second and third threaded rods each having a respective second end extending inwardly from the frame and having a respective second and third clamping member mounted thereon, such that a workpiece of irregular shape may be securely clamped between the independently adjustable first, second and third clamping members.

2. The clamping assembly of claim 1, wherein the second and third clamping assemblies each have a respective second and third flat strap section which are slidably received in the flattened tubular frame of the first and second legs respectively, the second and third flat strap sections each having a plurality of spaced-apart transverse openings therein, the tubular frame of the tubular frame of the first leg and the second leg each having at least one transverse opening therein such that when the respective flat strap slides in respective tubular frame of the leg, the selected opening in the second and third flat strap section communicates with the opening in the respective first and second leg permitting the second and third clamp to be adjusted outwardly from the end of the respective first and second leg; a first and second leg pin member removably received in the respective opening in the second and third flat strap section and in the respective communicating opening in the first and second leg such that the second and third clamping members are secured to the respective first and second legs; means to secure the respective first and second leg pin members.

3. The clamping assembly of claim 1, wherein a fixed clamping head is adjustably mounted on the end of the first leg such that the clamping head may be extended outwardly from the end of the first leg.

* * * * *